United States Patent [19]

Yoshikawa et al.

[11] Patent Number: 4,883,264

[45] Date of Patent: Nov. 28, 1989

[54] BILL DISBURSING SYSTEM

[75] Inventors: Eiichi Yoshikawa, Hasuda; Takashi Shinozaki, Kashiwa; Takahiko Ito, Yokohama, all of Japan

[73] Assignee: Laurel Bank Machines Co., Ltd., Tokyo, Japan

[21] Appl. No.: 264,798

[22] Filed: Oct. 31, 1988

[30] Foreign Application Priority Data

Nov. 2, 1987 [JP] Japan ..... 62-277897

[51] Int. Cl.[4] ..... B65H 7/08

[52] U.S. Cl. ..... 271/110; 271/256; 271/258; 271/149; 271/155; 271/162; 324/234; 324/236

[58] Field of Search ..... 271/110, 111, 256, 258, 271/259, 263, 265, 149, 155, 162; 209/548, 534, 567; 324/234–238; 361/180

[56] References Cited

U.S. PATENT DOCUMENTS

| | | | |
|---|---|---|---|
| 3,791,516 | 2/1974 | Tramsposct | 271/265 |
| 3,893,022 | 7/1975 | Kulik et al. | 324/236 |
| 4,764,725 | 8/1988 | Bryce | 324/234 |
| 4,790,525 | 12/1988 | Mitz et al. | 271/111 |

FOREIGN PATENT DOCUMENTS

| | | | |
|---|---|---|---|
| 35086 | 10/1979 | Australia . | |
| 0207778 | 1/1987 | European Pat. Off. . | |
| 214149 | 10/1909 | Fed. Rep. of Germany . | |
| 6833 | 1/1981 | Japan . | |
| 6438 | 2/1982 | Japan . | |
| 58-202234 | 11/1983 | Japan | 271/256 |
| 62-125489 | 6/1987 | Japan . | |
| 1296770 | 11/1972 | United Kingdom . | |

*Primary Examiner*—H. Grant Skaggs

*Attorney, Agent, or Firm*—Fleit, Jacobson, Cohn, Price, Holman & Stern

[57] ABSTRACT

A foreign substance disposing device for a money receiving and disbursing machine comprising stationary clip plates for clipping the bills therebetween, movable clip plate for clipping the bills, pick out rollers for picking out the bills which are clipped between the stationary and movable clip plates, a pick out motor for controlling an operation of the pick out rollers, a detection coil provided on a circuit board for producing a change in impedance in response to passing of the bills, impedance detector for detecting the change in the impedance of the coil, controller for judging whether or not the bills passing the coil are accompanied by a foreign substance based on signals from the impedance detector and for providing the pick out rollers with a control signal for preventing the pick out rollers from picking the bills out when a foreign substance is detected, and alarm for receiving signals from the controller and producing an alarm signal.

15 Claims, 7 Drawing Sheets

BILL DISBURSING SYSTEM

BACKGROUND OF THE INVENTION

1. Field of the Invention

The present invention relates to a foreign substance disposing device for a money receiving and disbursing machine, particularly to a device for detecting foreign substances or undesirable things introduced into a money receiving and disbursing machine together with bills to be received and disbursed and for removing the foreign substances from the machine.

2. Description of the Prior Art

In the case where a foreign substance undesirably accompanies bills which are introduced into a money receiving and disbursing machine for properly being processed, the foreign substance may cause a trouble in an operation of the machine as a result that the foreign substance plugs a bill transmitting path to impede a conveyance of the bill and/or to damage a mechanism of the bill transmitting path.

In view of the above, there have been proposed various systems for detecting such foreign substance accompanying the bills to be processed in the machine and for removing it from the machine.

Japanese patent public disclosure No. 62-125489, laid open to the public on June 6, 1987, discloses a foreign substance disposing device having a pair of rods provided at a bottom portion of a bill receiving opening and extending in a direction crossing bills introduced into a money machine. In this device, the bills being introduced into the money machine is carried by the pair of rods while a foreign substance accompanying the bills introduced into the machine falls by gravity between the rods to be separated from the bills and to be removed from the machine. According to the device disclosed in the above Japanese patent public disclosure, most of the foreign substances accompanying the bills can be removed by making use of the force of nature acting on the foreign substances introduced into the machine.

It should however be noted that the device disclosed in the above Japanese application cannot separate a foreign substance from the bills and thus cannot remove the foreign substance from the machine in such a case where the foreign substance adheres to the bills, for instance, where the foreign substance is of a clip which usually holds the bill and sticks to the bill.

As a result, there might happen a trouble that when a plurality of the bills bundled by a clip is introduced into the machine, the bundled plural bills will be picked out from a feed roller concurrently resulting in a plug of the roller and in turn in some cases, a shut down of the machine. In addition, such clip stick to the bills is tend to damage the feed roller or other mechanisms for conveying the bills if the clip is of a metal.

SUMMARY OF THE INVENTION

It is therefore an object of the present invention to provide a foreign substance disposing device for a money receiving and disbursing machine which can dispose of foreign substances undesirably accompanying the bills effectively .

It is another object of the present invention to provide a foreign substance disposing device for a money receiving and disbursing machine which can detect and separate foreign substances even where the foreign substances adhere to the bills without failure.

The above and other object of the present invention can be accomplished by a foreign substance disposing device for a money receiving and disbursing machine comprising stationary clip means for clipping the bills therebetween, movable clip means for clipping the bills, pick out means for picking out the bills which are clipped between said stationary clip means and movable clip means, pick out control means for controlling an operation of said pick out means, coil means provided on circuit board means for producing a change in impedance in response to passing of the bills, impedance detecting means for detecting the change in the impedance of the coil means, control signal output means for judging whether or not the bills passing the coil means are accompanied by a foreign substance based on signals from said impedance detecting means and for providing said pick out means with a control signal for preventing the pick out means from picking the bills out when a foreign substance is detected, and alarm means for receiving signals from said output means and producing an alarm signal.

In another feature of the invention, there is provided a foreign substance disposing device for a money receiving and disbursing machine comprising a pair of movable clip means for receiving the bills introduced into said money receiving and disbursing machine for clipping the bills therebetween, transfer means for transferring said movable clip means holding one of the bills between a first position where said movable clip means receives the bill and a second position where the bill held by said clip means is picked out, transfer control means for controlling an operation of said transfer means, pick out mean for picking out the bill which is clipped between the pair of said movable clip means, pick out control means for controlling an operation of said pick out means, coil means provided on circuit board means which is mounted on said movable clip means for producing a change in impedance in response to passing of the bills, impedance detecting means for detecting the change in the impedance of the coil means, control signal output means for judging whether or not the bills passing the coil means are accompanied by a foreign substance based on signals from said impedance detecting means, for providing said pick out means with a control signal so as to prevent the pick out means from picking the bills out and providing said transfer means with a signal for moving in a reverse direction against a normal transfer direction for the bill to position said movable clip means at the first position when a foreign substance is detected, and alarm means for receiving signals from said output means and producing an alarm signal.

According to the above features of the present invention, the foreign substances introduced into the money receiving and disbursing machine together with the bills are detected magnetically so that the foreign substance can be found out easily and quickly without failure even where the foreign substance adheres to the bill.

The pick out means will stop picking the bill out as soon as the foreign substance is detected so that the foreign substance can be easily taken out of the machine. As a result, the money receiving and disbursing machine can be prevented from plugging of the bills and therefore damaging thereof effectively.

According to the other feature of the present invention, the foreign substance is returned at a receiving position whenever it is detected so that it can be easily removed from the machine.

The above and other objects of the present invention will be apparent from the following descriptions of preferred embodiments taking reference with the accompanying drawings.

DESCRIPTION OF THE PREFERRED EMBODIMENTS

Figure 1:
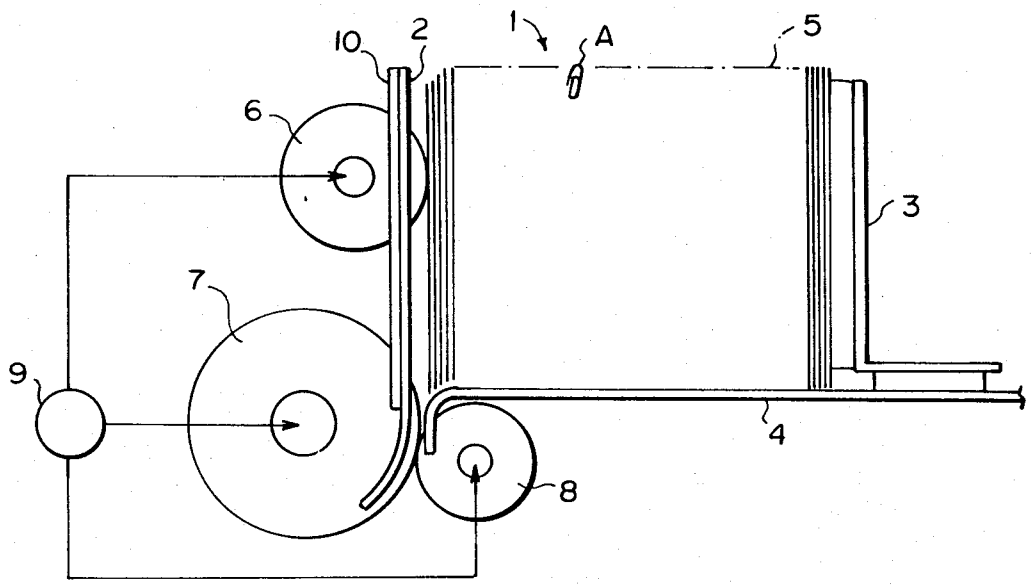
FIG. 1 is a schematic side view of an essential portion of a money receiving and disbursing machine to which the present invention can be applied.

Referring to the drawings, specifically to FIG. 1, there is shown a schematic view of an essential portion of a money receiving and disbursing machine to which the present invention can be applied.

In FIG. 1, a bill receiving section 1 of the money receiving and disbursing machine is provided with a stationary clip plate 2, a movable clip plate 3 and a bottom plate 4. The bill is introduced from a receiving window (not shown) to the bill receiving section 1. The movable clip plate 3 is urged forwardly toward the stationary clip plate 2 by means of a spring (not shown). The movable clip plate 3 is positioned so as to define a space with the stationary clip plate 2 in which space the bill 5 can be introduced. There is provided a pair of kick out rollers 6 forward of the stationary clip plate 2. A rotation axis of the kick out rollers 6 is perpendicular to a plane including FIG. 1. A rear portions of the kick out rollers 6 project rearwardly through an opening formed on the stationary clip plate 2 so that the rear ends of the kick out rollers 6 are brought into contact with a surface of the foremost bill 5 which is held between the stationary clip plate 2 and the movable clip plate 3. Beneath the kick out rollers 6, there are provided a pick out roller 7 for taking the bill 5 out of the bill receiving section 1 and a separation roller 8 adapted to be contacted with the pick out roller 7 and to be rotated in a reverse direction against that of the pick out roller 7. The bill 5 is kicked out of the receiving section 1 by the kick out rollers downwardly, and picked out through the pick out roller 7 from the receiving section 1 while the bill 5 is prevented from a duplicated pick out operation where two or more bills are concurrently picked out of the receving section 1 by virtue of a frictional force exerted by the separation roller 8, the kick out rollers 6, pick out roller 7 and separation roller 8 are adapted to be driven by a pick out motor 9. In this embodiment, there is illustrated a foreign substance A such as a clip.

Figure 4:
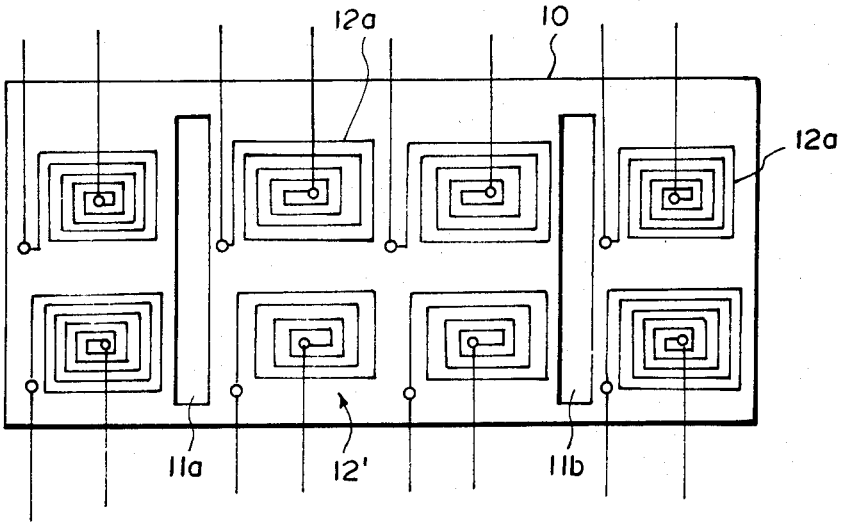
FIG. 4 is a schematic view of an arrangement of detection coil provided on a printed circuit board.

On a front side of the stationary clip plate is mounted a print circuit board 10 formed with a pair of windows 11*a* and 11*b* facing to the opening of the stationary clip plate 2 as shown in FIG. 4. On the print circuit board 10 there is provided a printed circuit of a spiral-like configuration to constitute a detecting coil 12 which is connected with a detecting circuit 13 for detecting a change in impedance of the coil 12.

The detecting circuit 13 is constituted by an oscillating circuit 14 for producing a certain signal of a constant frequency and amplitude, an amplifying circuit 15 for amplifying the oscillation signal from the oscillating circuit 14, a single-shot flip-flop circuit 16 for judging whether or not the amplitude of the oscillation signal is smaller than a predetermined level, an output circuit 17 for outputting a signal from the flip-flop circuit 16 and a power supply circuit 18 for supplying a power for the circuit 14, 15, 16 and 17. The detecting circuit 13 is adapted to detect a foreign substance other than the bill within a magnetic field generated by the coil 12 by detecting the impedance change in the coil and to input a signal to a control signal output circuit 19.

When a foreign substance of a metal or other magnetic material is brought into the magnetic field generated by the coil 12, there is generated an eddy current inside of the foreign substance so as to reduce the magnetic field strength of the coil. As a result, the impedance of the coil 12 is increased as the foreign substance approaches the coil 12. This causes a reduction of the amplitude of the oscillation signal of the oscillating circuit 14. When the amplitude of the oscillation signal is lowered less than the predetermined level, the flip-flop circuit 16 is actuated so that the output circuit 17 produces a signal denoting that the foreign substance is detected. The signal from the output circuit is introduced into the control signal output circuit 19.

The control signal output circuit 19 is constituted by a micro computer and produce a prohibition signal for a motor controller 20 and an alarm signal for an alarm device 21 when the control signal output circuit 19 received the signal from the output circuit 17. The motor controller 20 stops driving the pick out motor 9 when received the prohibition signal from the control signal output circuit 19. The alarm device 21 produces a visual alarm signal on a display section 21 and an aural signal from an aural signal producing section 21*b*.

There is provided a start switch 22 for actuating the device. When an operator turns on the switch 22 and a detecting circuit 23 detects the operation of the switch 22, the bill 5 is picked out toward the machine and the detecting operation of foreign substance is initiated.

Figure 2:
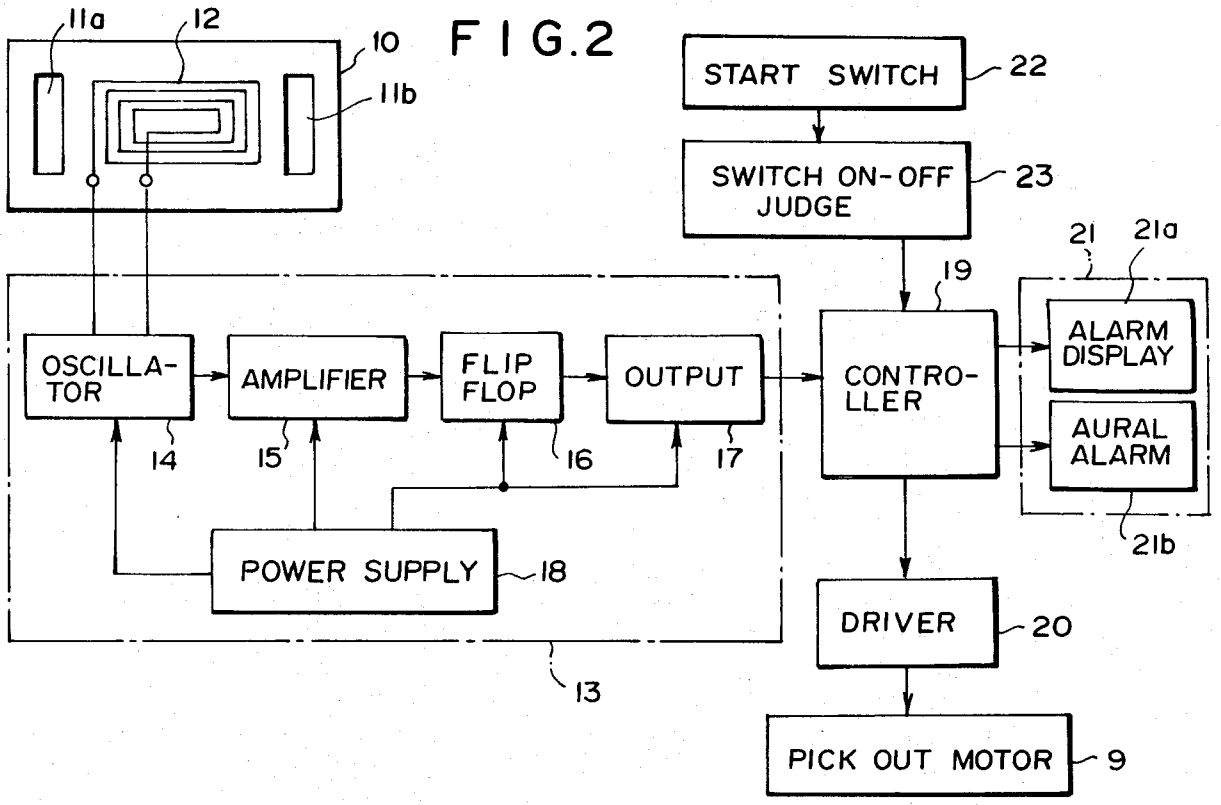
FIG. 2 is a block diagram of a foreign substance disposing device.
Figure 3:
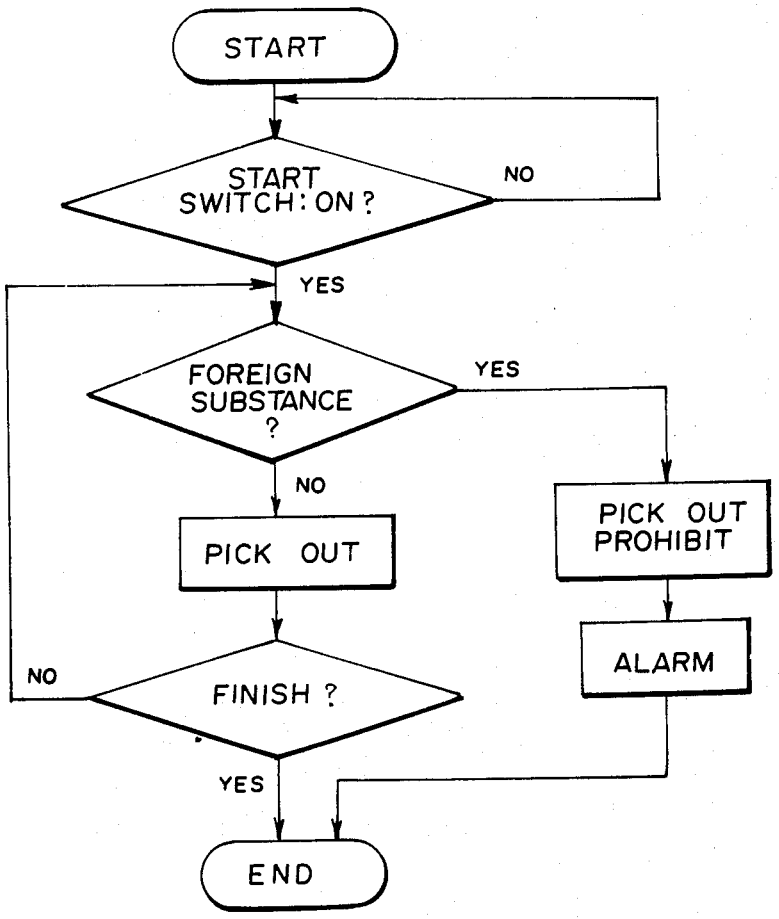
FIG. 3 is a flow chart showing a control in the foreign substance disposing device of FIG. 2.

There is shown a flow chart in FIG. 3 disclosing an operation of the device as aforementioned in connection with FIGS. 1 and 2.

In operation, when the introduction of the bills 5 into the money receiving and disbursing machine is completed, it is judged whether or not the start switch 22 is on through the detecting circuit 23. Where the switch 22 is on, the judgment is made as to whether a foreign substance A is accompanied by the bills 5 by means of the coil 12 and the detecting circuit 13.

When a foreign substance is detected, the detecting circuit 13 produces a signal to the control signal output circuit 19. The control signal output circuit 19 produces a prohibition signal to the motor control circuit 20 so as to prohibit to drive the motor 9 and produces an alarm signal to the alarm device 21 so that the display section 21 indicates visually and aurally that there is a foreign substance in the bills 5 introduced in the receiving section 1 through the display section 21*a* and aural signal producing section 21*b*.

The foreign substance A detected can be removed from the machine through any suitable means. For instance, the substance A can be removed manually by the operator or a supervisor of the machine from the receiving section 1 before and after an initiation of the pick out operation of the bills stored in the receiving section 1.

According to the above embodiment, the foreign substance A can be removed without failure before it is introduced into the rollers 6, 7 and 8 so that plugging of the bill in the device and damage of the device can be prevented effectively.

Now referring to FIG. 4, there is shown another arrangement of the detecting coil 12'. In this embodiment, there are provided four spiral coil pieces 12*a* between the windows 11*a* and 11*b*, and two sets of coils constituted by a pair of spiral coil pieces 12 outside of windows 11*a* and 11*b* respectively.

It should be noted that as a distribution area of a spiral coil is increased compared to the size of foreign substance, a detection accuracy is reduced since a change in the impedance induced in the coil becomes faint in the case where a foreign substance crosses the magnetic field of the coil. In this regard, providing a plurality of spiral coil pieces as shown in FIG. 4 is advantageous in that the detection accuracy can be improved and such an improved detection accuracy can be obtained uniformly across the bill examined. In the case where a detection coil is constituted by a plurality of spiral coil pieces as shown in FIG. 4, signals from the detection coil are introduced through an OR circuit to the control signal output circuit 19 wherein the pick out operation of the bill is prohibited when one of the coil pieces detected a foreign substance.

Hereinafter there is described another embodiment of the present invention taking reference with FIGS. 5 and 6.

Figure 5:
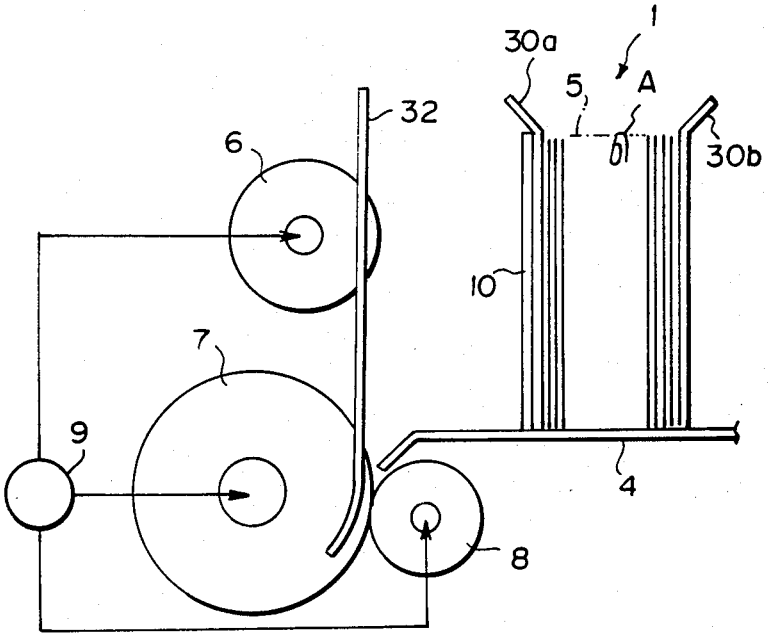
FIG. 5 is a similar view to FIG. 1 but showing another embodiment of the present invention.

FIG. 5 shows an essential part of a money receiving and disbursing machine as well as FIG. 1.

Figure 6:
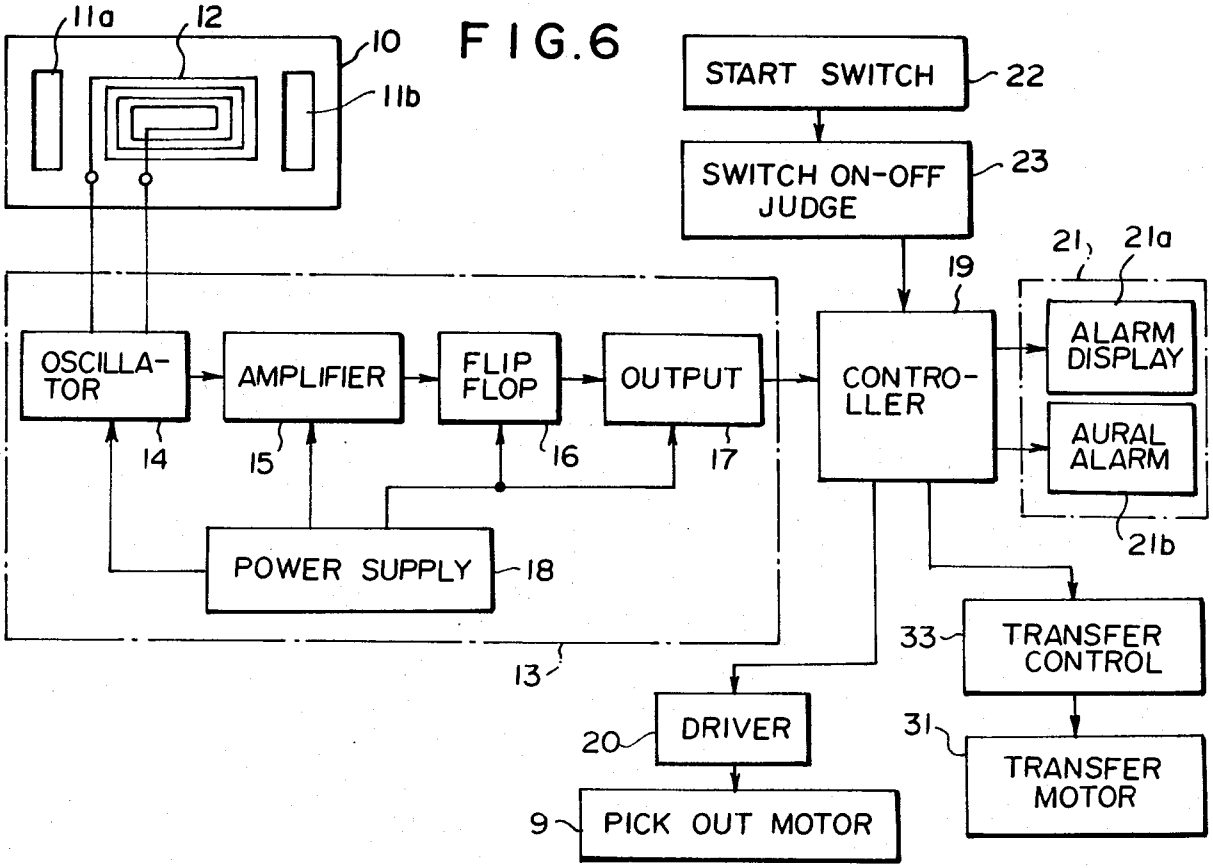
FIG. 6 is a block diagram of a foreign substance disposing device similar to FIG. 2 but showing another embodiment of the present invention.

FIG. 6 shows a block diagram of a foreign substance disposing device.

Corresponding components are designated by the same reference numerals as in the previous embodiments and detail explanations thereto are omitted.

The bill receiving section 1 is provided a pair of movable clip plates 30*a* and 30*b* which are located at a position spaced rearwardly from a stationary clip plate 32. This structure is effected to prevent the movable clip plate 30*a* from contacting with the rollers 6, 7 and 8 during bill receiving operation of the section 1 so that an adjustment of the rollers 6, 7 and 8 is not affected by the bill receiving operation to thereby obtain a proper pick out operation of the bill at any time.

The movable clip plates 30*a*, 30*a* can be moved by means of a transfer motor 31 shown in FIG. 6 from a rearward position where the bills 5 are introduced into the bill receiving section to a forward position where the bills 5 are pick out of the section 1 after the bill receiving operation is finished. There is provided a hole (not shown) on the bottom plate 4 for introducing downwardly a foreign substance by gravity between the rearward and forward position.

Referring to FIG. 6, the foreign substance disposing device according to the illustrated embodiment, there are provided with a transfer control circuit 33 for controlling an operation of the transfer motor 31.

Figure 7:
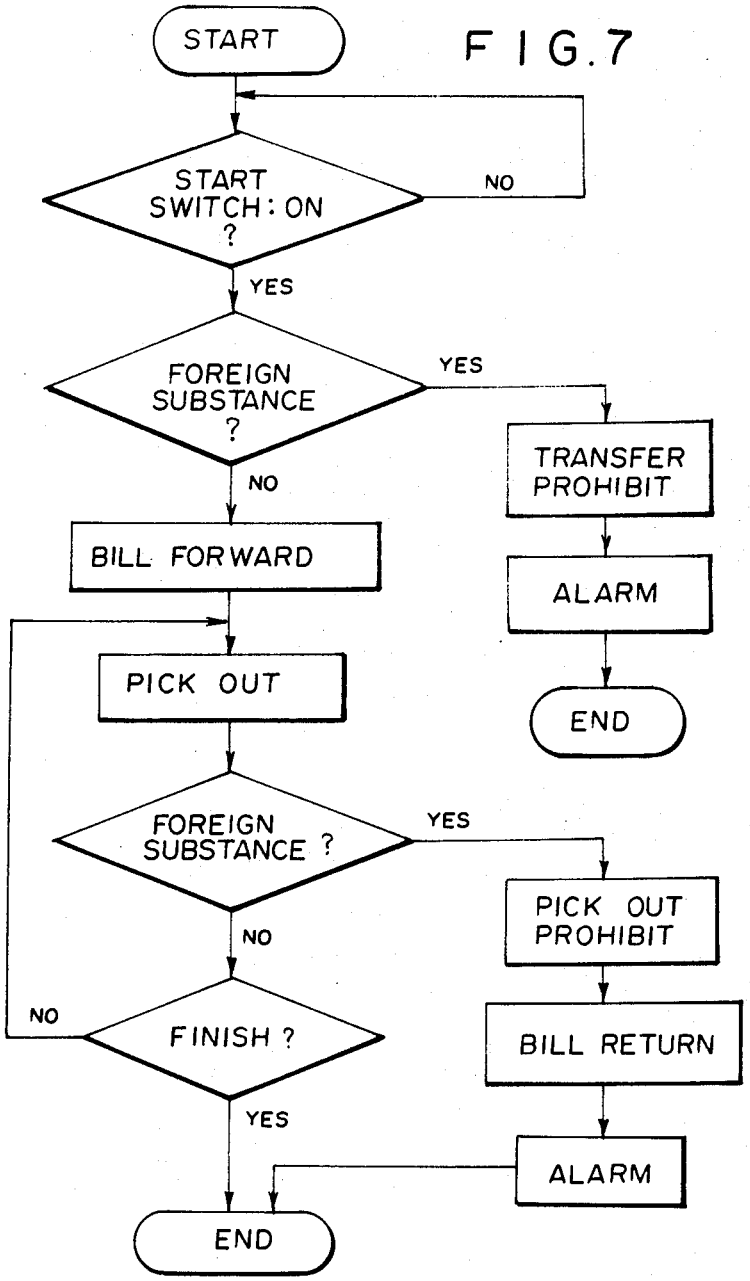
FIG. 7 is a flow chart showing of the foreign substance disposing device similar to FIG. 3 but showing another embodiment of the present invention.

There is shown a flow chart for a control of the foreign substance disposing device in FIG. 7 similar to FIG. 3 of the previous embodiment.

In this embodiment, when a foreign substance is detected before the bills 5 in the section 1 are transferred to the forward position to be picked out, the control signal output circuit 19 produce an alarm signal to the alarm device 21 and at the same time causes the transfer motor 31 to prohibit the movement of the movable clip plates 30*a*, 30 toward the forward position.

When a foreign substance is detected after the bills 5 in the section 1 were transferred to the forward position for being picked out by means of the transfer motor 31 or after the initiation of the picking out operation of the bills 5, the control signal output circuit 19 produces an alarm signal to the alarm device 21 and a prohibition signal to the pick out motor control circuit 20 as in the previous embodiment. In addition, the control signal output circuit 19 provides the transfer motor control circuit 33 with a reverse signal for moving the movable clip plates 30*a*, 30*b* reversely. As result, the motor 31 is rotated in the reverse direction to move the movable clip plates 30*a*, 30*b* reversely back to the rearward position. Thereafter, the foreign substance can be removed from the bill receiving section 1 in any of a suitable way. For instance, the operator can take out manually from the section 1 after a shutter of a transaction window adjacent to the section 1 is opened.

In the embodiments aforementioned, although a spring is provided for holding the bills between the clip plates resiliently, a motor can be employed for holding the bills between the clip plates in a manner that the motor is actuated to drive the clip plates to clip the bills therebetween after a completion of bill receiving operation.

The start switch control circuit 23 can be constituted to let the operator know an off-condition of the switch 22.

The detection coil 12 and the detecting circuit 13 are not limited to so-called high-frequency oscillator type proximity switch which normally oscillates and stops the oscillation when a foreign substance approaches thereto. They can be constituted by any kind of proximity switch utilizing an electromagnetic induction such as a differential transformer type proximity switch, induction bridge type proximity switch which does not oscillate normally and begins to oscillate when a foreign substance approaches thereto, and the like.

It will be apparent from the above description that although various modifications and variations may be made by those skilled in the art without departing from the spirit of the present invention, all the modifications and the like fall into the claims as attached.

We claim:

1. A foreign substance disposing device for a money receiving and disbursing machine comprising stationary clip means and movable clip means for clipping bills therebetween, pick out means for picking out the bills which are clipped between said stationary clip means and movable clip means, pick out control means for controlling an operation of said pick out means, coil means provided on circuit board means for producing a change in impedance in response to passing of the bills, impedance detecting means for detecting the change in the impedance of the coil means, control signal output means for judging whether or not the bills passing the coil means are accompanied by a foreign substance based on signals from said impedance detecting means and for providing said pick out means with a control signal for preventing the pick out means from picking the bills out when a foreign substance is detected, and alarm means for receiving signals from said output means and producing an alarm signal.

2. A foreign substance disposing device in accordance with claim 1 wherein the improvement is provided with the circuit board means constituted by a printed circuit board.

3. A foreign substance disposing device in accordance with claim 1 comprising the coil means of a spiral-like configuration arrangement.

4. A foreign substance disposing device in accordance with claim 3 comprising the arrangement is constituted by a plurality of coil pieces of the spiral-like configuration.

5. A foreign substance disposing device in accordance with claim 1 wherein the impedance detecting means is constituted by a high-frequency oscillator type proximity switch.

6. A foreign substance disposing device in accordance with claim 1 wherein the impedance detecting means is constituted by a induction bridge type proximity switch.

7. A foreign substance disposing device in accordance with claim 1 the impedance detecting means is provided on the stationary clip means.

8. A foreign substance disposing device for a money receiving and disbursing machine comprising a pair of movable clip means for receiving bills introduced into said money receiving and disbursing machine for clipping the bills therebetween, transfer means for transferring said movable clip means holding one of the bills between a first position where said movable clip means receives the bills and a second position where the bills held by said clip means is picked out, transfer control means for controlling an operation of said transfer means, pick out means for picking out the bills which is clipped between the pair of said movable clip means, pick out control means for controlling an operation of said pick out means, coil means provided on circuit board means which is mounted on said movable clip means for producing a change in impedance in response to passing of the bills, impedance detecting means for detecting the change in the impedance of the coil means, control signal output means for judging whether or not the bills passing the coil means are accompanied by a foreign substance based on signals from said impedance detecting means, for providing said pick out means with a control signal so as to prevent the pick out means from picking the bills out and providing said transfer means with a signal for moving in a reverse direction against a normal transfer direction for the bills to position said movable clip means at the first position when a foreign substance is detected, and alarm means for receiving signals from said output means and producing an alarm signal.

9. A foreign substance disposing device in accordance with claim 8 wherein the improvement is provided with the circuit board means constituted by a printed circuit board.

10. A foreign substance disposing device in accordance with claim 8 comprising the coil means of a spiral-like configuration arrangement.

11. A foreign substance disposing device in accordance with claim 10 comprising the arrangement is constituted by a plurality of coil pieces of the spiral-like configuration.

12. A foreign substance disposing device in accordance with claim 8 wherein the impedance detecting means is constituted by a high-frequency oscillator type proximity switch.

13. A foreign substance disposing device in accordance with claim 8 wherein the impedance detecting means is constituted by a induction bridge type proximity switch.

14. A foreign substance disposing device in accordance with claim 8 the impedance detecting means is provided on one of the movable clip means.

15. A foreign substance disposing device in accordance with claim 8 wherein the movable clip means are located at a position spaced from the pick out means.

* * * * *